US008251367B2

(12) United States Patent
Yu

(10) Patent No.: US 8,251,367 B2
(45) Date of Patent: Aug. 28, 2012

(54) BOARD AND BOARD GAME WITH TIMING FEATURES

(75) Inventor: Brian M. Yu, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 858 days.

(21) Appl. No.: 12/210,687

(22) Filed: Sep. 15, 2008

(65) Prior Publication Data

US 2009/0102121 A1 Apr. 23, 2009

Related U.S. Application Data

(60) Provisional application No. 60/972,368, filed on Sep. 14, 2007.

(51) Int. Cl.
*A63F 3/00* (2006.01)
*A63F 9/24* (2006.01)

(52) U.S. Cl. ..... 273/272; 463/10; 463/11; 463/12; 463/31; 463/35

(58) Field of Classification Search ..... 273/272
See application file for complete search history.

(56) References Cited

U.S. PATENT DOCUMENTS

| | | | | |
|---|---|---|---|---|
| 2,752,158 | A | 6/1956 | Brunot et al. | |
| 3,149,841 | A | 9/1964 | Hullman | |
| 3,520,072 | A | 7/1970 | Greenwood | |
| 3,630,526 | A | 12/1971 | Winkless, III | |
| 3,858,333 | A | 1/1975 | Kopp | |
| 3,863,931 | A | 2/1975 | Forsyth et al. | |
| 3,926,439 | A | 12/1975 | Chao et al. | |
| 4,106,773 | A | 8/1978 | Coefield | |
| 4,240,638 | A | 12/1980 | Morrison et al. | |
| 4,340,947 | A | 7/1982 | Barton | |
| 4,895,364 | A | 1/1990 | Martel et al. | |
| 5,087,052 | A | 2/1992 | Simon | |
| 5,395,118 | A | 3/1995 | Barrett | |
| 5,460,381 | A | 10/1995 | Smith et al. | |
| 5,529,308 | A | 6/1996 | Masakayan | |
| 5,615,886 | A * | 4/1997 | Chalfin et al. | 273/272 |
| 5,839,976 | A | 11/1998 | Darr | |
| 5,893,718 | A | 4/1999 | O'Donnell | |
| 5,921,864 | A | 7/1999 | Walker et al. | |
| 6,182,966 | B1 | 2/2001 | Wells et al. | |

(Continued)

FOREIGN PATENT DOCUMENTS

EP 1302223 A1 4/2003

(Continued)

OTHER PUBLICATIONS

IGN Staff, "Who Wants to Be a Millionaire?", Dec. 13, 1999, ign.com, available at <http://pc.ign.com/articles/163/163563p1.html>.*

(Continued)

*Primary Examiner* — David L Lewis
*Assistant Examiner* — Werner Garner
(74) *Attorney, Agent, or Firm* — Cantor Colburn LLP

(57) ABSTRACT

A board game with a timing feature is disclosed. The board game includes a board with several bonus spaces or premium spaces that can change in value and/or availability as a game progresses. The board also includes indicator associated with the bonus or premium spaces that indicate whether the bonus or premium spaces are available and whether their values have changed.

19 Claims, 8 Drawing Sheets

U.S. PATENT DOCUMENTS

| | | | | |
|---|---|---|---|---|
| 6,322,074 | B1 | 11/2001 | Forrest et al. | |
| 6,378,867 | B1 | 4/2002 | Shalless | |
| 6,386,539 | B1 | 5/2002 | Deskovick | |
| 6,422,561 | B1 | 7/2002 | Schroeder | |
| 6,446,966 | B1 | 9/2002 | Crozier | |
| 6,446,967 | B1 | 9/2002 | Jamali | |
| 6,581,933 | B1 | 6/2003 | Zivan | |
| 6,602,133 | B2 | 8/2003 | Chan | |
| 6,769,692 | B1 | 8/2004 | Cavalluzzo | |
| 6,921,074 | B2 | 7/2005 | Cavallo | |
| 7,008,316 | B1 | 3/2006 | Pugh | |
| 7,044,467 | B1 | 5/2006 | Dimmig | |
| 7,118,110 | B2 | 10/2006 | Kowalczyk | |
| 2001/0034256 | A1 | 10/2001 | Green | |
| 2002/0063386 | A1 | 5/2002 | Bates et al. | |
| 2003/0026172 | A1 | 2/2003 | Eagle | |
| 2003/0230848 | A1 | 12/2003 | Mellerowicz | |
| 2004/0094894 | A1 | 5/2004 | Lertdee | |
| 2004/0130097 | A1 | 7/2004 | Krug | |
| 2004/0145114 | A1 | 7/2004 | Ippolito et al. | |
| 2004/0242295 | A1 | 12/2004 | Ghaly | |
| 2004/0248650 | A1* | 12/2004 | Colbert et al. | 463/37 |
| 2005/0151318 | A1 | 7/2005 | Tarantini | |
| 2005/0243655 | A1 | 11/2005 | McCutcheon et al. | |
| 2005/0285338 | A1* | 12/2005 | Cusolito | 273/146 |
| 2006/0012122 | A1 | 1/2006 | Botzen | |
| 2007/0018393 | A1* | 1/2007 | Ritter et al. | 273/272 |

FOREIGN PATENT DOCUMENTS

| | | | |
|---|---|---|---|
| FR | 2755273 | A | 4/1998 |
| GB | 2241900 | A | 9/1991 |
| GB | 2296197 | A | 6/1996 |

OTHER PUBLICATIONS

International Search Report dated May 27, 2009, International Filing Date Sep. 15, 2008 for PCT/US2008/076398.

Written Opinion dated May 27, 2009, International Filing Date Sep. 15, 2008 for PCT/US2008/076398.

* cited by examiner

BOARD AND BOARD GAME WITH TIMING FEATURES

CROSS REFERENCE TO RELATED APPLICATION

This application claims the benefit of priority of U.S. Provisional Application Ser. No. 60/972,368 filed Sep. 14, 2007, the contents of which are incorporated herein by reference thereto.

BACKGROUND THE INVENTION

The present invention relates generally to a game, and more particularly, to a game board that has a timing feature. The present invention also relates to methods of game play using a game board with a timing feature.

SUMMARY OF THE INVENTION

The invention relates to a board and a board in which players take turns playing tokens or game pieces on the board. Each player receives points for the particular game pieces that he or she plays, such as by the formation of words, phrases, images, or other objects. The game board includes different areas or spaces with which the different game pieces can be associated by a player: During a turn, a player can place one or more game pieces on the game board if the game pieces are combinable together themselves or with pieces that are already on the board). Each game piece has a value associated therewith. When a player plays one or more game pieces, that player is awarded points that correspond to the collective value of the played game piece(s) that turn. A goal of the game is to be the player at the end of the game who has the most points.

In one embodiment, different areas or spaces of the game board may affect the points awarded to a player. These areas or spaces can affect the awarded value of one game piece or the combination of game pieces that are played at one time. Some of the areas or spaces are bonus spaces or premium spaces for which extra points can be awarded. For example, one type of bonus space has the function of multiplying the value of the game piece played thereon by a number, such as two or three. Another type of bonus space has the function of multiplying the collective value of the played combination of game pieces, provided that at least one of the game pieces is played on the bonus space, by a number, such as two or three. An example of one type of game in which game pieces have values and players are awarded points based on the game piece or pieces that are played on a game board is the game SCRABBLE®.

In one embodiment, these different areas or spaces may change in terms of their function or operation as the game progresses. The spaces can be illuminated during game play to indicate their availability to a player or players. The availability of the bonus spaces on the game board can change as the game progresses. The progression of the game can be monitored by a timing mechanism or system that can track: the length of time played on a player-by-player basis or for a game-as-a-whole basis. The timing mechanism can keep track the length of time that a particular player has played the game by cumulatively adding together the periods of time of the player's turns. The timing mechanism can be turned on at the start of a player's turn and turned off when the player has completed the turn. Such an activation of the timing mechanism can start the for next player's turn. The game may include a controller and a memory component in which the length of game play time for a player is stored and updated accordingly.

The game includes an electronic system that controls the functions of the game board and in particular, the bonus spaces. In one embodiment, there may be three or four different types of functions or bonus features that are assigned to and performed by certain spaces or cells on the game board. In one implementation, one type of function or bonus may be "turned off" or unavailable to a player after a certain period of time has passed. Similarly, a second type of function or bonus may be "turned off" or unavailable to a player after an additional period of time has passed. The types of functions or bonus features and the time periods at which they are no longer available to one or more players can vary between different implementations of the game and methods of playing the game. In another implementation, the value of a bonus space may increase and/or decrease during a game. In different embodiments, the manner in which the bonus spaces change in value and/or become unavailable can vary. The timing feature of the game increases the pressure on the players during the game and creates a fun and new game and method of game play.

The above-described and other features are appreciated and understood by those skilled in the art from the following detailed description, drawings, and appended claims.

DETAILED DESCRIPTION

Various terms may be used herein to designate and reference the same or similar structures of the invention. For example, the terms "areas," "spaces," "zones," and "cells" may be interchangeably used to designate a portion of the game board on which a game piece may be played and to which a function may be associated. The terms "token," "game piece," "playing piece," and "tile" may be used interchangeably herein to designate an object or item that can be used with the game board during game play. The terms "bonus space," "premium space," and "function cell" may be used interchangeably herein to designate portion of the game board that has a function or bonus associated therewith. Also, the terms "timer," "timing mechanism," and "timing system" may be used interchangeably herein to designate an element or component that can perform the timing operation as referenced in this description.

Figure 1:
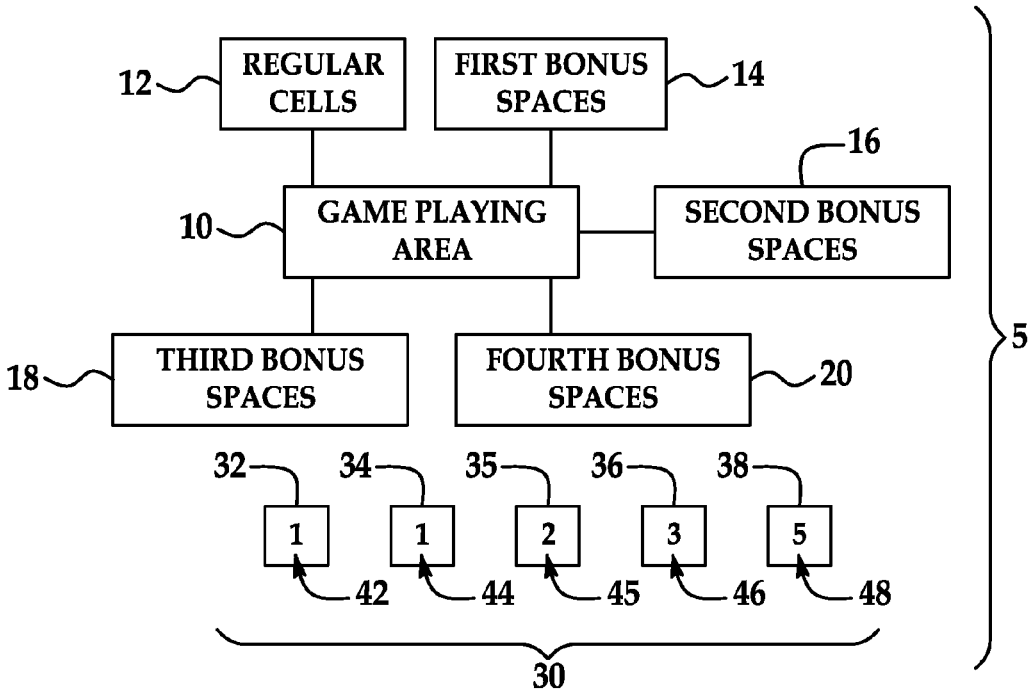
FIG. 1 illustrates a schematic block diagram of an embodiment of a game according to the present invention.

Referring to FIG. 1, an embodiment of a game according to the present invention is illustrated. In this embodiment, game 5 includes a game playing area 10. The game playing area 10 may be divided into multiple areas or spaces. Some examples of different spaces that can be included in game area 10 are illustrated in FIG. 1. In one embodiment, the game may involve playing different tokens or game pieces on the spaces. Each of the game pieces may have a value associated with it, When a player plays one or more game pieces on the game playing area 10, the player may be awarded the cumulative value of the set or combination of game pieces played in that turn and the game pieces on the board with which the playing pieces were associated or coupled. To play the one or more game pieces, there must be a linkage between them, such as the game pieces collectively form a word, a mathematical equation, a picture or image, a sentence, or other item. A common linkage could be established by a rule, such as a rule provided in instructions that accompany the game. One example of a rule is that a combination must be all consonants or all vowels to be playable. Another example of a rule is that a combination must be repeating letters to be played.

As in FIG. 1, the game playing area 10 may include regular value spaces 12 and bonus spaces with different types of functions or bonus features 14, 16, 18, and 20. In one embodiment, the function of a bonus space can be to provide a bonus to a player. For example, the function cells or bonus spaces can provide increased values to a player relative to a regular space, and thereby change the play of the game. In one implementation, the first type of bonus space 14 is the doubling of the value of the game piece that is played on the bonus space 14. A second type of bonus space 16 can be the tripling of the value of the game piece that is played on the bonus space 16. Other types of functions can be provided as described in detail below. Also, in various embodiments, the quantity of different functions available can be either fewer than or more than four.

The game set 5 also includes several game pieces 30 with associated "values" that are used to calculate points. Game piece 32 includes value indicia 42 associated therewith. In this embodiment, value indicia 42 is the number "1". Game piece 34 includes value indicia 44 in the form of the number "1." Game piece 35 includes value indicia 45 in the form of the number "2." Game piece 36 includes value indicia 46 in the form of the number "3". Finally, game piece 38 includes value indicia 48 in the form of the number "5". Game pieces 30 are intended to be exemplary and any number of game pieces 30 can be provided for use with the game playing area 10. In one embodiment, the game pieces can be substantially square-shaped tiles. In different embodiments, the game pieces may have any shape, configuration, material, value and/or indicia associated therewith.

As previously mentioned, the availability of the functionality of the first bonus spaces 14, the second bonus spaces 16, the third bonus spaces 18, and the fourth bonus spaces 20 can vary as a game progresses. For example, at the start of a game, all four types of functions may be available to the players. After a certain amount of game play time has elapsed, one of the functions may no longer be available to one or more of the players because of the elapsed time. After an additional amount of game play time has elapsed, another one of the functions may no longer be available to one or more of the players. Similarly, after additional game play time periods have elapsed, other functions may no longer be available to one or more of the players.

The periods at which the different functions or bonus features may be no longer available can vary between different embodiments of the game and different methods of playing the game. For example, the first bonus spaces may be unavailable after five minutes of game play has elapsed. Moreover, the second bonus spaces may be unavailable after ten minutes of game play has elapsed. Similarly, the third bonus spaces may be unavailable after fifteen minutes of game play has elapsed. These periods of game play time can be predetermined by the game. Alternatively, these periods of time may be adjustable by the players on a game-by-game basis. In other words, players may be allowed to determine and set the game play times at which the different bonus space types become unavailable.

In one embodiment, the game play time is tracked on a player-by-player basis. In particular, the length of time that a player takes for each of the player's turns is tracked and maintained on a cumulative basis. With each additional turn that the player has, the amount of game play time is increased accordingly. Thus, the availability of the bonus spaces is determined on a player-by-player basis based on the amount of game play time that the particular player has had. The game determines what bonus spaces are available for the current player and indicates that availability accordingly. In an alternative embodiment, which may be indicative of tournament play, the game play time is tracked on an overall game basis, which starts when the first player's turn begins. In this mode, the game does not track the amount of time a particular player has played and the unavailability of the items applies to all players.

Figure 2:
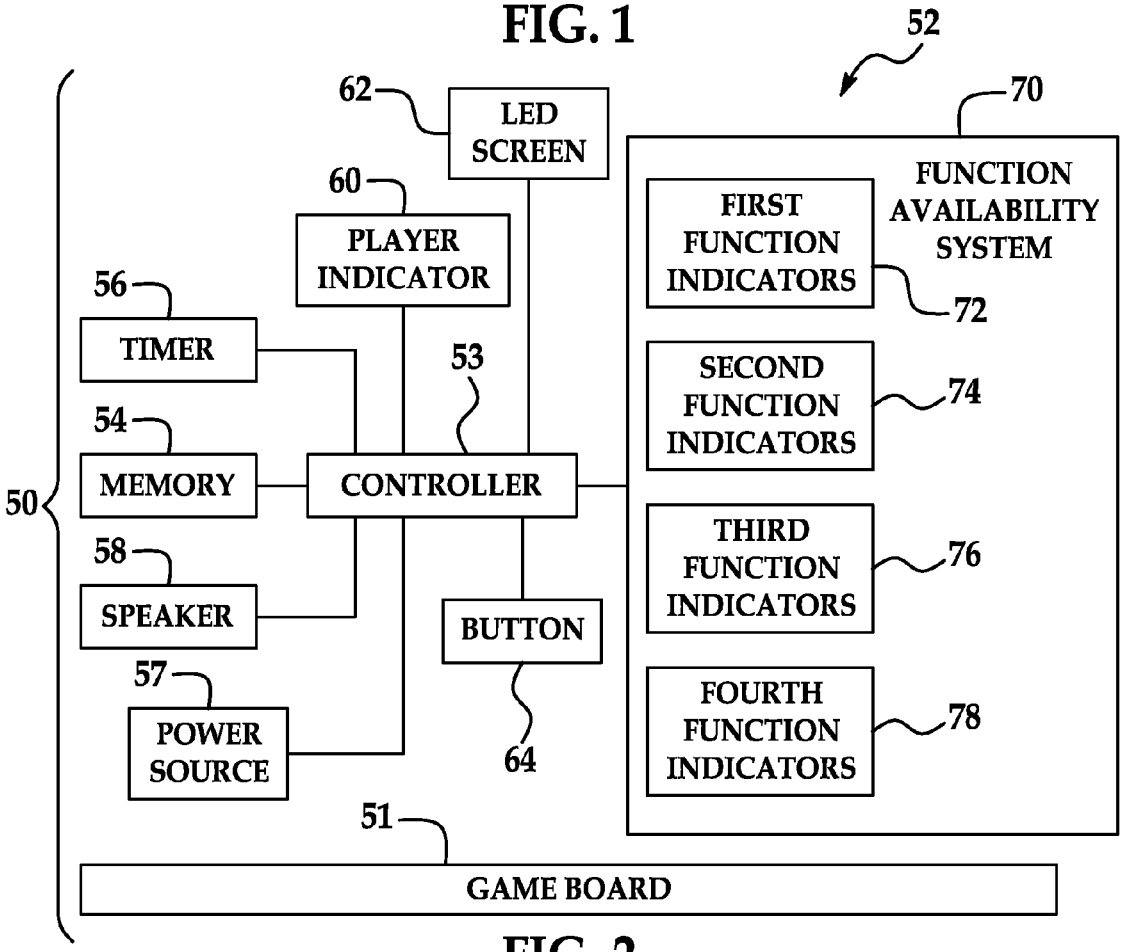
FIG. 2 illustrates a functional block diagram of an embodiment of a game according to the present invention.

Referring to FIG. 2, an alternative embodiment of a game according to the present invention is illustrated. In this embodiment, the game 50 includes a game board 51, an electronic system 52, and playing or game pieces (not illustrated). The electronic system 52 may include any combination of electrical components provided that the functionality and game play described herein can be achieved. In this exemplary embodiment, the electronic system 52 includes a controller 53, a memory unit 54, a timer or timing mechanism 56, a power source 57 (which can be any type of battery, cell, or other source of power), and an audible output device 58 (such as a speaker). The electronic system 52 also includes outputs for the players relating to the game. In particular, the system 52 includes a player indicator 60 that designates which player is considered by the game to be the current player. The system 52 also includes a display or visual output device 62, such as an LCD display screen, that can be used to show the elapsed game play time for the current player. Alternatively, the elapsed game play time for the game as a whole, and not for a particular player only, can be displayed on device 62. The system 52 also includes a button 64 that can be used by one or more players to provide an input to the system 52. For example, the button 64 may be actuated to designate the start or end of a period of time, such as a player's turn. Alternatively, the button 64 may be used to input the quantity of players that will be participating in a game. The electronic system 52 also includes programming and software elements and components which control the operation of the game and in particular, the function of the bonus spaces of the game board. The electronic system 52 can be disposed within the housing 110 of the game board, as discussed below.

The system 52 also includes an indication of available functions or bonus spaces. In FIG. 2, a system 70 for designating the availability of the different bonus spaces is illustrated. The system 70 utilizes visual outputs to designate the availability of the bonus spaces. The system 70 includes first function or bonus space indicators 72, second function or bonus space indicators 74, third function or bonus space indicators 76, and fourth function or bonus space indicators 78. In one embodiment, the indicators are light output devices, such as light emitting diodes or LEDs, that are illuminated to show the availability of bonus spaces. In another embodiment (not shown), indicator lighting may be provided by light piping, such as with fiber optics, using multiple indicators at the positions described hereinafter. The indicators can be disposed proximate to bonus spaces, such as next to, on top of, or beneath the bonus spaces. For example, when the first bonus spaces are available, the first indicators 72 are illuminated or turned on. When the second bonus spaces are available, the second indicators 74 are illuminated. When the third bonus spaces are available, the third indicators 76 are illuminated. When the fourth bonus spaces are available, the fourth indicators 78 are illuminated. When particular bonus spaces are no longer available, then the corresponding indicators are no longer illuminated.

Figure 3A:
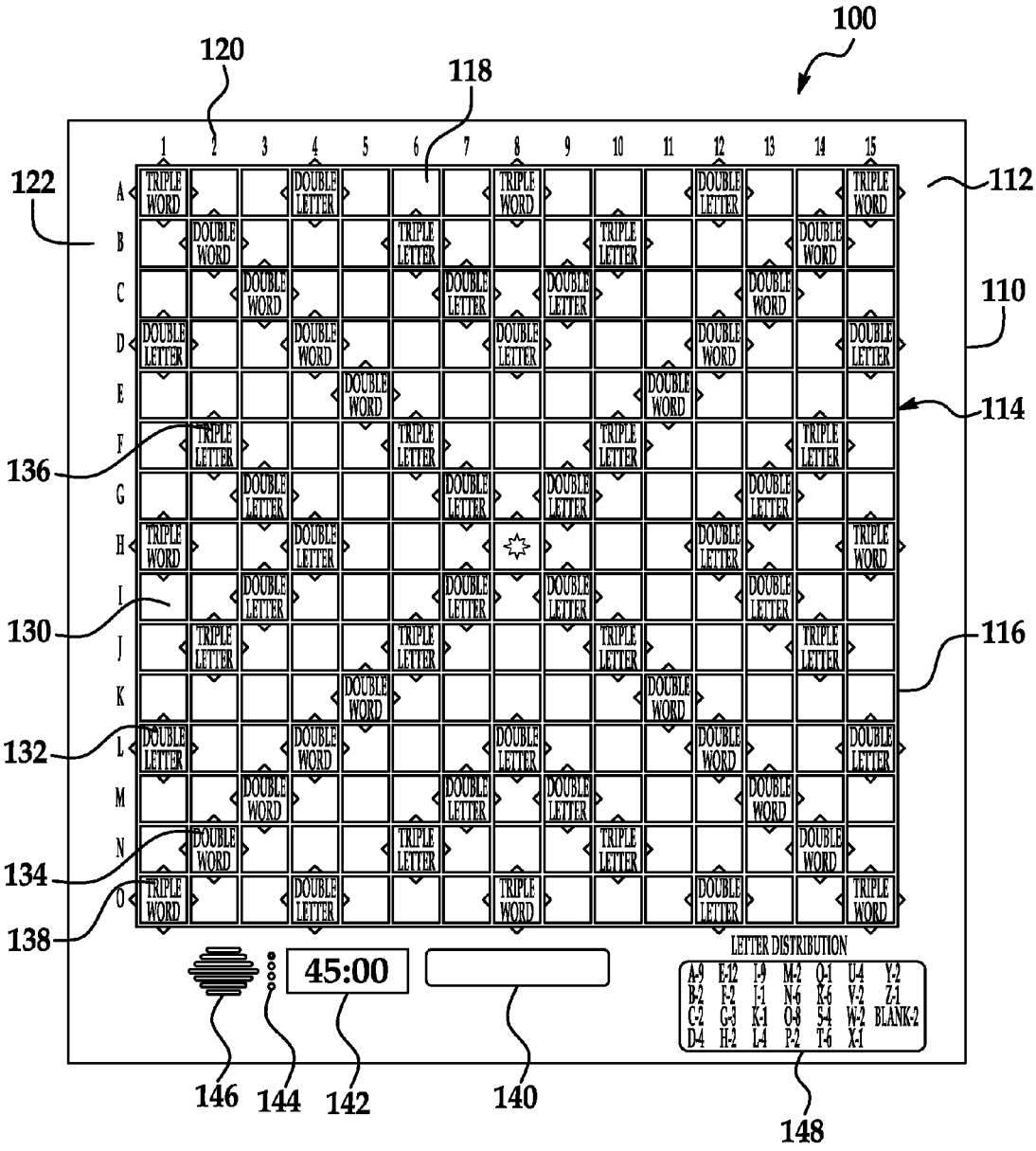
FIGS. 3A and 3B illustrate a top view and a perspective view of an embodiment of a game according to the present invention, respectively.
Figure 3B:
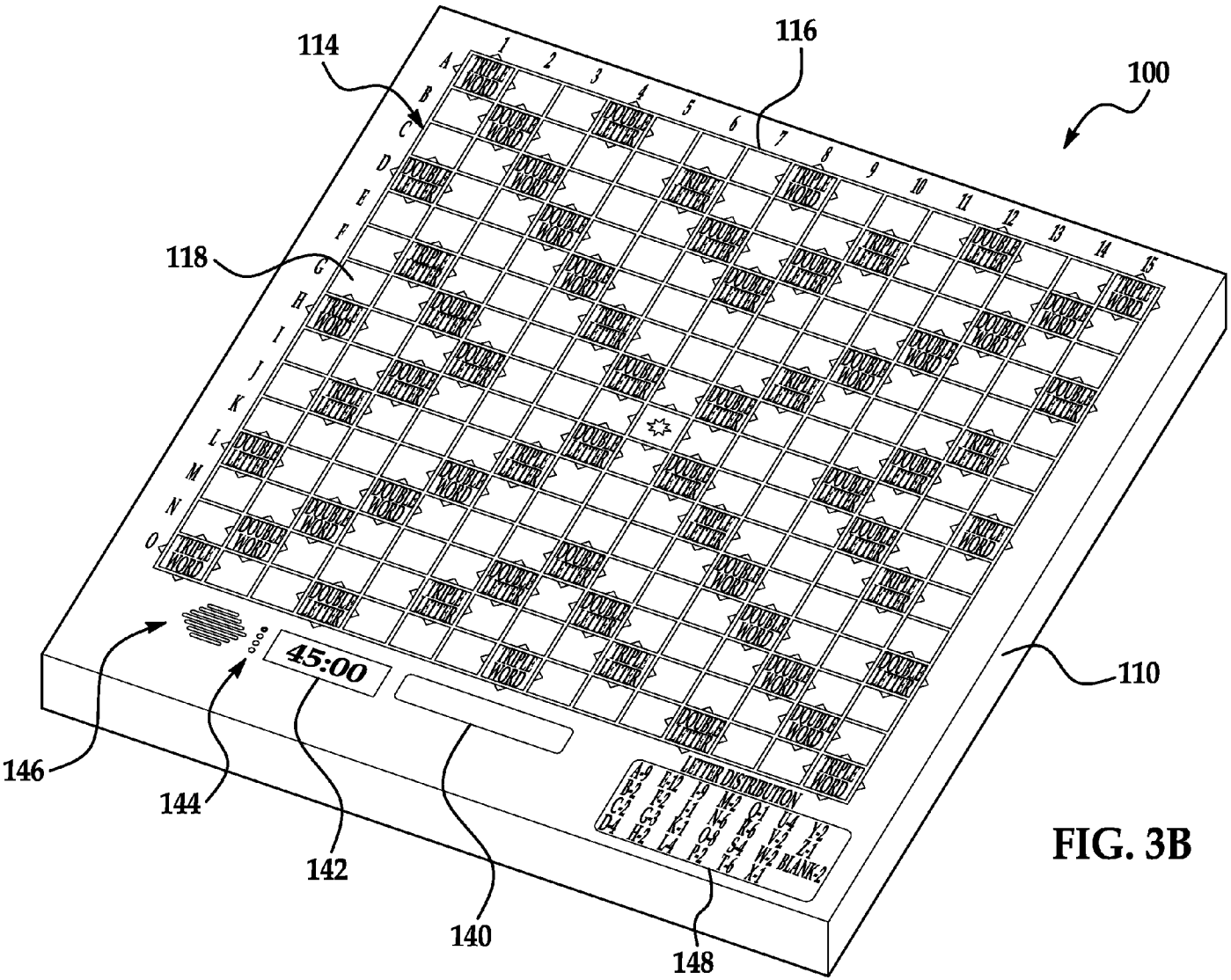

Referring to FIGS. 3A and 3B, an embodiment of a game according to the present invention is illustrated. In this embodiment, game 100 includes a housing 110 with a game play surface or area 112 on which a game board 114 is disposed or defined. The game board 114 may be formed as part of the housing 110 or separate from and coupleable to the housing 110. The game board 114 includes a grid 116 that defines various cells, areas or spaces 118 in columns and rows. Column indicia 120 are provided to designate different columns of spaces. Row indicia 122 are provided to designate different rows of spaces. While numbers and letters are used as column and row indicia respectively, in various embodiments, the type of indicia used can vary. The game board 114 functions as a game playing area on which different game pieces can be positioned.

The game board 114 includes different types of spaces or cells 118. Referring to FIGS. 3A and 3B, cells 118 include regular spaces 130, first bonus spaces 132, second bonus spaces 134, third bonus spaces 136, and fourth bonus spaces 138. The locations of the different bonus spaces 132, 134, 136, and 138 are spread apart on the game board 114. The quantity of bonus spaces on the game board 114 can vary in different embodiments. The different bonus spaces will be described in greater detail with respect to FIGS. 4 and 5. In this embodiment, the game board 114 includes fifteen columns spaces and fifteen rows of spaces for a total of 225 playing spaces on the game board or game playing area. In one embodiment, there are approximately sixty bonus spaces on the game board 114. In other embodiments, the quantity and locations of bonus spaces can vary.

Referring to FIGS. 3A and 3B, the housing 110 includes a game button 140 that the players can use to provide inputs, an LCD screen or display 142 to display game play time elapsed or remaining, a current player indicator 144, a speaker 146, and a letter distribution legend 148, which corresponds to the quantity of letter playing pieces available for the game. In various embodiments, any combination of all or some of these features may be included with the game 100.

Figure 4:
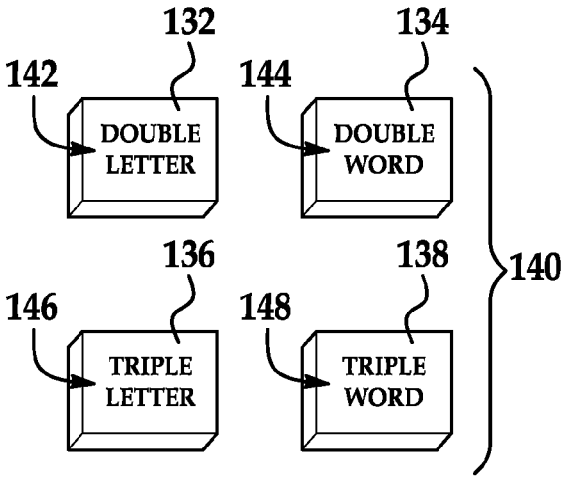
FIG. 4 illustrates exemplary embodiments of spaces with indicia of the game illustrated in FIG. 3A.

Referring to FIG. 4, a set 140 of bonus spaces or function cells is illustrated. In this set 140, bonus space 132 includes indicia 142 designating the particular function or bonus associated therewith. In this embodiment, indicia 142 indicates the "double letter" functionality of the bonus space 132. Similarly, bonus space 134 includes indicia 144, bonus space 136 includes indicia 146, and bonus space 138 includes indicia 148. The bonus spaces 132, 134, 136, and 138 can be made of clear plastic so that a light emitting device can be seen therethrough. In one embodiment, the colors of one or more of the light emitting devices can vary so that the bonus spaces have different appearances. For example, blue LEDs or fiber optics can be used with the first bonus spaces 132 and the second bonus spaces 134, orange LEDs or fiber optics can be used with the third bonus spaces 136, and red LEDs or fiber optics can be used with the fourth bonus spaces 138. In other embodiments, the colors of the LEDs or fiber optics can vary.

Figure 5:
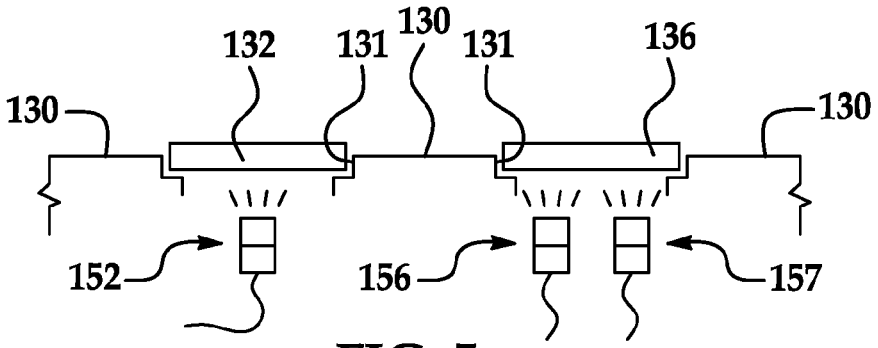
FIG. 5 illustrates a cross-sectional view of some components of the game illustrated in FIG. 3A.

Referring to FIG. 5, a partial cross-section of some of the components of the game housing 110 are illustrated. First bonus space 132 and third bonus space 136 are shown as located between regular spaces 130 which provide support for the first and third bonus spaces 132 and 136. While bonus spaces 132 and 136 are illustrated as mounted in openings 131, the bonus spaces 132 and 136 can be coupled to or support on the playing surface of the housing 110 in a variety of ways.

A light emitting device 152, such as an LED, is disposed beneath the first bonus space 132 so that light is shown through the bonus space 132 and visible to the players. Another light emitting device 156, such as an LED of a different color than LED 152, is disposed beneath the third bonus space 136 so that light is shown through the third bonus space 136 and visible to the players. The light emitting devices 152 and 156 are illuminated when their respective bonus spaces are available. The light emitting devices 152 and 156 are exemplary of visual output indicators that can be used with the different bonus spaces according to the invention. Additional types and quantities of light emitting devices can be provided. As described above, light piping or fiber optic lines may be used to light respective bonus spaces. In some embodiments, more than one LED can be associated with a bonus space, with each of the LEDs having a different color. In a like manner, multiple light pipes or fiber optic lines of differing colors and intensities may be used. Referring to FIG. 5, LEDs 156 and 157 are associated with bonus space 136. LEDs 156 and 157 can be different colored LEDs which are alternately illuminated to cause bonus space 136 to have a different appearance and color, which can be a way to designate a change in value of bonus space 136 as described below.

The bonus spaces of the game board can vary in value and/or availability in a variety of ways. As previously discussed, the availability of bonus spaces for a player or players can be determined based on the amount of game play time. In one implementation, there are different types or categories of bonus spaces on a game board. The game board is configured so that one category of bonus spaces is unavailable after a first period of time, regardless of where on the game board the bonus spaces are located. A second category of bonus spaces is unavailable after a second period of time, regardless of where on the game board the second category bonus spaces are located. The game board can be configured so that additional categories or types of bonus spaces become unavailable based on the elapsing of particular periods of time on a player-by-player basis or a game-as-a-whole basis. While four different types of bonus spaces are illustrated, a game board can have any number of bonus space categories.

In another implementation of the game board, the bonus spaces have a particular value or function associated therewith. For example, a bonus space may have the value of doubling the value of a game piece that is played on or associated therewith. Alternatively, a bonus space may have the value of tripling the value of a game piece that is played on or associated therewith. Thus, some bonus spaces may have a greater value (be worth more points) than other bonus spaces.

The value of a bonus space can be indicated by text or other indicia that is provided with the bonus space. For example, the text "Double Letter" or "Triple Letter" can be used to designate or indicate the value of a bonus space, as described above. Alternatively, the bonus spaces can use other visual indicators, such as colors, to designate the values of the bonus spaces. For example, if a bonus space is a first color, such as blue, then its value or function can be the doubling of the value of a game piece associated therewith. Additionally, if a bonus space is a second color, such as red, then its value or function can be the tripling of the value of a game piece associated therewith. Similarly, if a bonus space is a third color, such as orange then its value or function can be the doubling of the value of a combination of game pieces. The color of a bonus space can be achieved by using different colored materials far the bonus space and/or different colored light output devices, such as LEDs or fiber optics. Thus, when a light emitting device proximate to a bonus space changes in color, then the particular bonus space changes in appearance (and in color) and the players can see that the bonus space value and/or availability has changed.

In one embodiment, instead of bonus spaces becoming unavailable during the game, the bonus spaces may change in value as the game progresses. Some bonus spaces may increase in value and some bonus spaces may decrease in value. In various embodiments, the bonus spaces may decrease in value only, increase in value only, or increase and decrease. One manner in which the indication of a change in bonus space value can be achieved is by changing the color of the bonus space. Using the exemplary colors described above as reference, a bonus space may change from a first color, such as blue, to a second color, such as red, after a period of time. The change in color reflects a change in function or value of the bonus space. In other words, as the bonus space changes from the first color to the second color, its function may change from doubling the value of a game piece to tripling the value of a game piece. The bonus spaces may decrease in value as well. A bonus space may change from a third color, such as orange, to a first color, such as blue. Such a change may reflect a change in value of the bonus space. In various embodiments, the quantity of colors and particular colors used may vary and the increases and decreases of functions or values of the bonus spaces can change in a predetermined manner or randomly. Also, the changing can occur on a predetermined basis or as selected by the players of the game.

In another implementation of the game board, the bonus spaces can become unavailable or their value change based on the location of the bonus spaces on the game board. In this case, instead of whole categories of bonus spaces becoming unavailable or having a change in value at once, the bonus spaces on the game board closest to the center of the game board are the first ones to be modified. The game board can be configured so that the indicators for the bonus spaces close to the center of the game board are turned off or changed first after a period of game play time, which be a fixed or random period of time. Thus, the bonus spaces can change or become unavailable in a pattern starting the center of the game board and continuing outwardly toward the outer perimeter of the game board. The change or unavailability of the bonus spaces in this implementation occurs regardless of the type of bonus space.

In another implementation of the game board, the bonus spaces can change in value or become unavailable based on the quantity of turns that a player or multiple players has during the game. For example, the game board may have three categories or types of bonus spaces available at the start of a game. After a player has had a certain quantity of turns, such as five, then one category or type of bonus space may change in value or become unavailable for the remainder of the game. After the player has had a certain quantity of additional turns, such as five more turns, than another category or type of bonus space may change in value or become unavailable.

The changing in value or unavailability of bonus spaces can be also determined on a game-as-a-whole basis in which the total number of player turns (as determined by the pressing of the function button on the game board) determines the values and/or availability of the bonus spaces. For example, after there has been collectively ten turns in the game, the value and/or availability of one or more bonus spaces can change. After another certain number of turns in the game, the value and/or availability of those and other bonus spaces can change.

Additionally, for bonus space value changes or unavailability based on quantity of turns, the changes can be made to bonus spaces depending on the location of the bonus spaces on the game board instead of on a category as a whole basis. For example, the game board can be configured so that the bonus spaces closest to the center of the game board change in value or become unavailable first after a certain quantity of turns, The changes will continue during the game in a direction from the center toward the outer perimeter. Alternatively, the changes can occur initially to the bonus spaces close to the perimeter of the game board and move inwardly toward the center of the game board.

In various embodiments, once a bonus space has changed in value during a game, it may subsequently change in value (higher or lower) during the game. Similarly, once a bonus space has become unavailable, it may become available to one or more players during the game. In other embodiments of the game board, the players may adjust difficulty settings of the game board with respect to particular players so that bonus spaces change in value (either increase or decrease) and/or availability at different rates for different players. If some players desire a more difficult game, then the game settings for those players can adjusted so that the bonus space changes occur more frequently. In one embodiment, more difficult game settings for a player may result in bonus space values only decreasing or becoming unavailable as opposed to bonus space values increasing as well.

Figure 6:
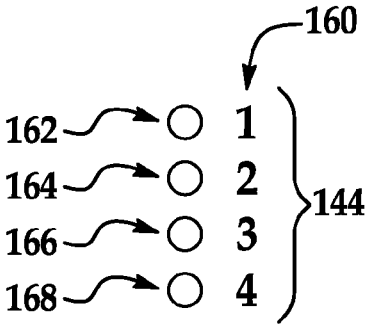
FIG. 6 illustrates the current player indicator of the game illustrated in FIG. 3A.

Referring to FIG. 6, the current player indicator 144 is shown. The current player indicator 144 includes the different quantities of players (as shown by reference 160) and visual indicators 162, 164, 166, and 168 that are illuminated, one at a time, to designate the particular player who currently has his or her turn. In one embodiment, the visual indicators 162, 164, 166, and 168 are red colored LEDs. In other embodiments, different colors and/or light emitting devices can be used.

Figure 7:
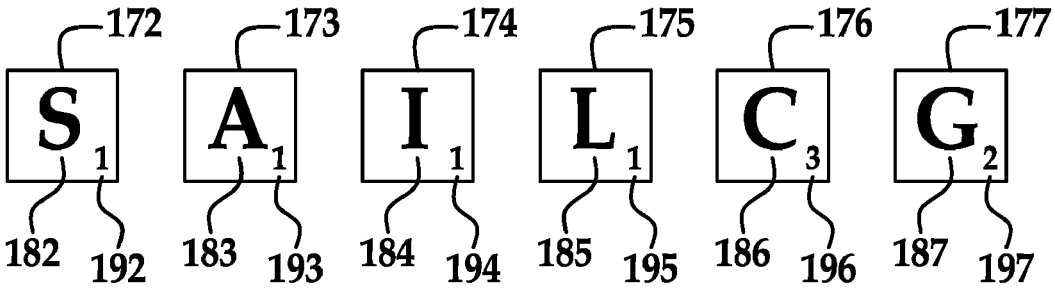
FIG. 7 illustrates different embodiments of game pieces according to the present invention.
Figure 8:
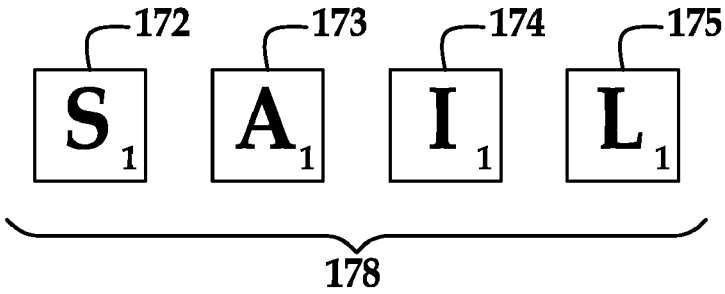
FIGS. 8 and 9 illustrate a combination of game pieces without and with a bonus space, respectively.
Figure 9:
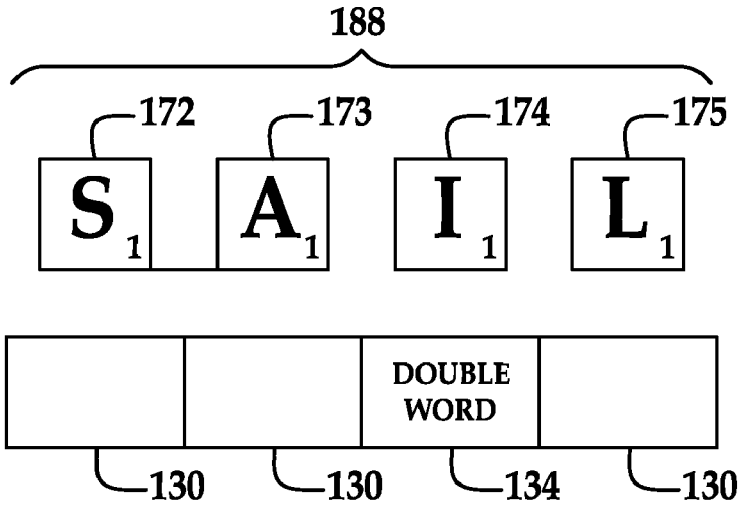

Referring to FIGS. 7-9, exemplary game pieces and combinations thereof are illustrated. In one embodiment, the game 100 can include game pieces 172, 173, 174, 175, 176, and 177, each of which includes an identifying indicator 182, 183, 184, 185, 186, and 187 and a particular value 192, 193, 194, 195, 196, and 197, respectively. In this and other embodiments, the quantity of game pieces can vary and the game pieces illustrated in FIG. 7 are exemplary only. The shape, size, configuration, indicators, values associated with game pieces to be used with game 100 can vary.

Referring to FIG. 8, a set or combination 178 of game pieces is illustrated. Combination 178 is formed using game pieces 172, 173, 174, and 175 which can be combined because they collectively form a word. The sum of the values of the game pieces in the combination 178 is four points.

Referring to FIG. 9, the use of a function cell or bonus space with a combination of game pieces is illustrated. Spaces 130 are regular spaces and bonus space 134 has the function of doubling the value of the word formed by game pieces played on the bonus space 134. In this example, the combination 188 played on spaces 130 and 134 has the value of eight points. While the first player must create a word with one letter on the center square of the game board, subsequent players form words and place them on the board to read across or down provided that an existing letter on the game board is incorporated into a new word. Each player gets points for the letters placed and letters on the board that are used to form a new word. The game pieces can be used with racks or holders for each player to facilitate the viewing and retaining of the game pieces. The game pieces can resemble the tile pieces from SCRABBLE®.

Figure 10:
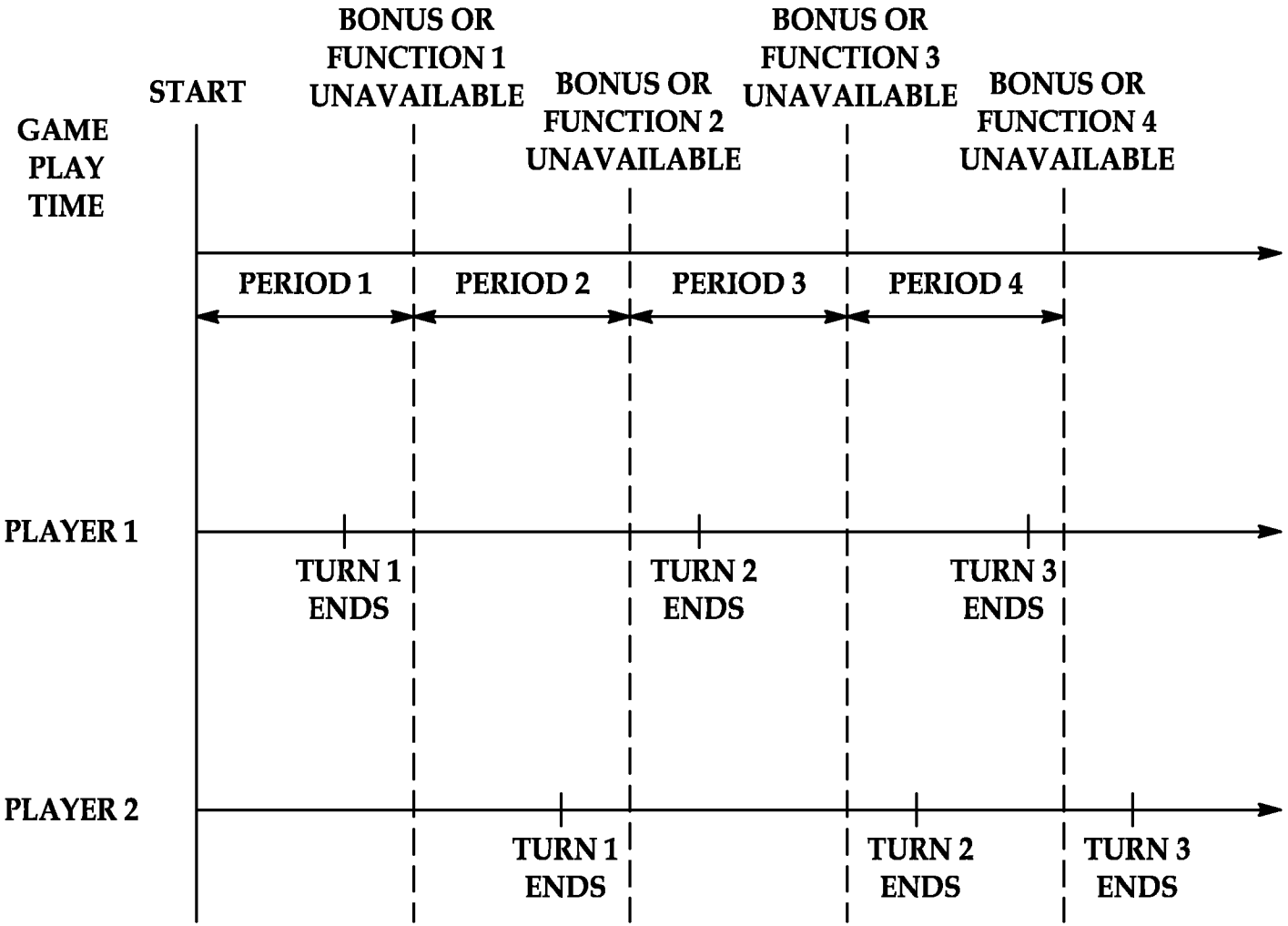
FIG. 10 illustrates a schematic diagram illustrating an exemplary method of game play according to the present invention.

Referring to FIG. 10, an exemplary schematic illustrating a timeline of a method of game play according to the invention is illustrated. The timeline includes a line that is representative of game play time or in other words, the time that is indicative of the game play that has elapsed. The timeline defines several periods of time, which can be either predefined or user adjustable, and which may be any amount of time. For this example, each of the time periods "Period 1," "Period 2," "Period 3," and "Period 4" is assumed to be five minutes for purposes of simplicity only. Thus, after "Period 1" or five minutes has elapsed, the first function becomes unavailable as indicated by the dashed line in FIG. 10. As the game play continues, after "Period 2" or an additional five minutes has elapsed, the second function becomes unavailable and the first function remains unavailable. As the game play continues, after "Period 3" or an additional five minutes has elapsed, the third function becomes unavailable and the first and second functions remain unavailable. As the game play continues, after "Period 4" or an additional five minutes has elapsed, the fourth becomes unavailable and the first, second and third functions remain unavailable. At this point in time, none of the functions of the bonus spaces is available to the player or players.

As described above, in one embodiment, the game play time is based on the game play of the players on a player-by-player basis. This arrangement is illustrated in FIG. 10. In other embodiments, the game play time may be calculated from the start of a game and continue regardless of the play time of the players.

Referring to FIG. 10, the game play time for Player 1 and the game play time for Player 2 are tracked and exemplary first three turns for each player are illustrated. Regarding Player 1, the first turn for Player 1 ends during Period 1 at the point designated as "Turn 1 Ends." That game play time is stored in memory until the next (in this case second) turn for Player 1. The timer for the second turn for Player 1 starts at that point and continues to "Turn 2 Ends," which occurs with in Period 3. Thus, during the second turn for Player 1, when Period 1 elapses, the first function or bonus is no longer available and the first function or bonus indicators are no longer illuminated. In addition, since Period 2 elapsed, the second function or bonus is no longer available and the second function or bonus indicators are no longer illuminated. The third turn for Player 1 continues until the time designated as "Turn 3 Ends." During the third turn of Player 1, Period 3 elapses and the third function or bonus indicators are not illuminated and the third function or bonus is not available. At the start of the fourth turn for Player 1, the fourth function is still available, but will not be available shortly thereafter.

Now the exemplary turns for Player 2 as illustrated in FIG. 10 are described. The first turn for Player 2 ends during Period 2 at the point "Turn 1 Ends." Thus, when Period 1 elapsed during that turn, the first function or bonus indicators were no longer illuminated and the first function or bonus was no longer available. The second turn for Player 2 ends during Period 4. Accordingly, when Period 2 and Period 3 elapse during that turn, the second and third function or bonus indicators are no longer illuminated and the second and third bonus features are no longer available. Finally, the third turn for Player 2 ends after Period 4 elapses. Therefore, during that third turn, the fourth function or bonus indicators are no longer illuminated and the fourth bonus feature is not available.

Figure 11:
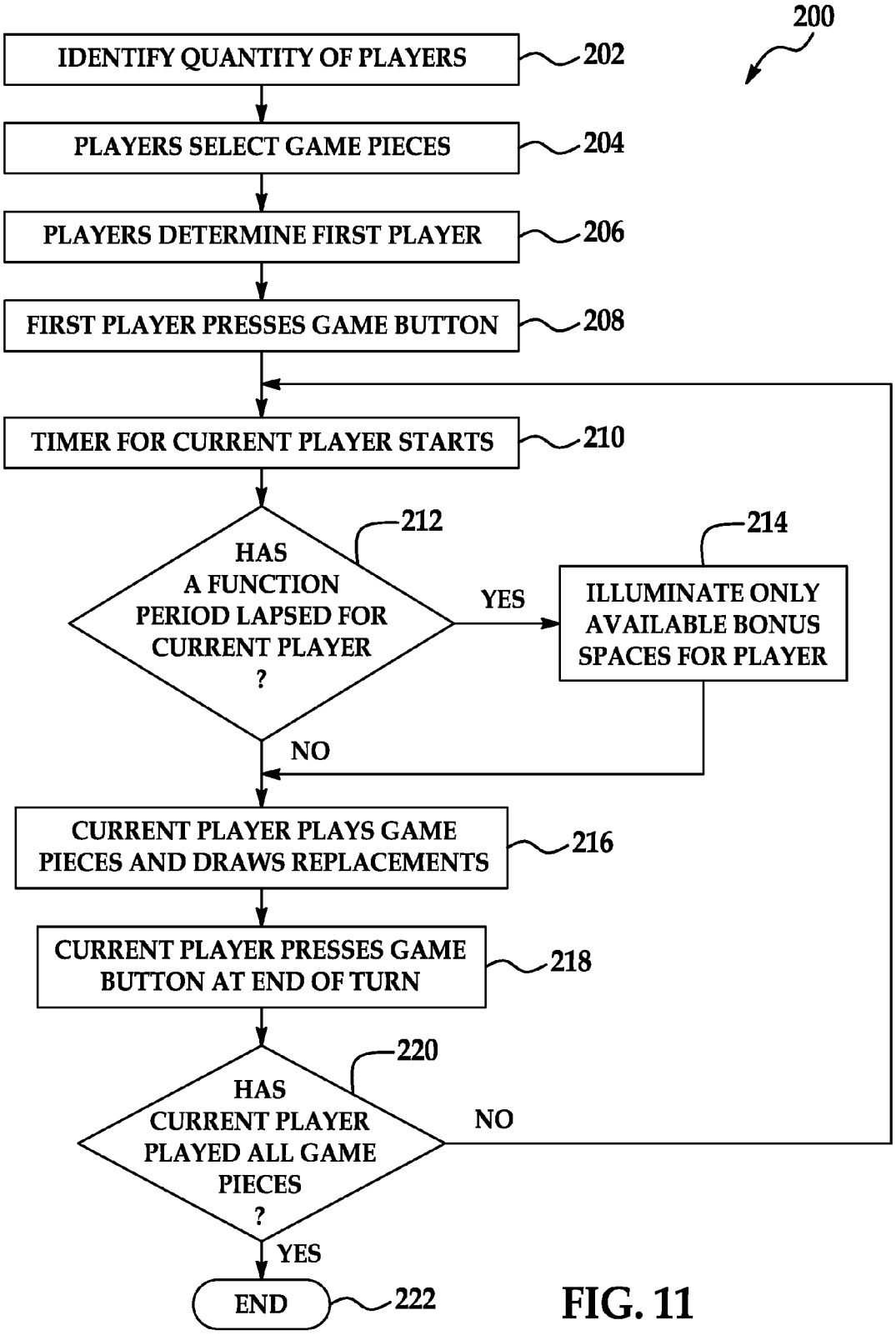
FIG. 11 illustrates an exemplary method of game play according to the present invention.

An exemplary method of game play is illustrated in FIG. 11. In this method, several steps and actions are illustrated and are intended to be exemplary of those that can be performed with a game according to the present invention. In various methods of game play, different steps and actions can be included with some or all of those illustrated in FIG. 11.

Figure 12:
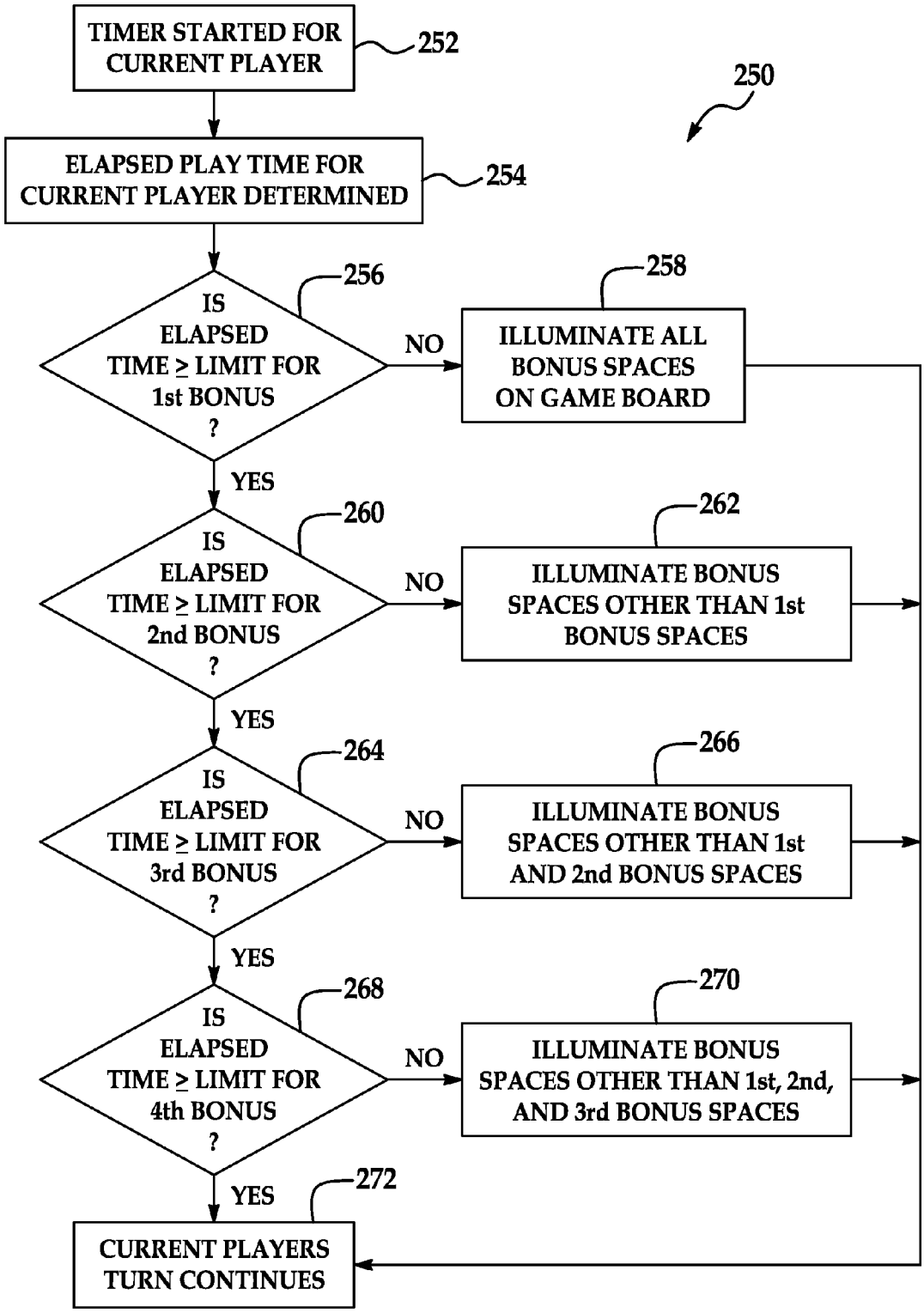
FIG. 12 illustrates another exemplary method of game play according to the present invention.

In one non-limiting embodiment, FIG. 11, and FIG. 12 which will be described herein, illustrates a control algorithm for a non-limiting exemplary embodiment of the present invention. In an exemplary embodiment, the algorithm of FIGS. 11 and 12 is resident upon a microprocessor of a controller (or microcontroller) 52 or other equivalent processing device, which may include memory 53, capable of executing commands of computer readable data or program for executing a control algorithm that controls the operation of the game 50. In order to perform the prescribed functions and desired processing, as well as the computations therefore (e.g., the execution of fourier analysis algorithm(s), the control processes prescribed herein, and the like), the controller 52 may include, but not be limited to, a processor(s), computer(s), memory 53, storage, register(s), timing, interrupt(s), communication interfaces, and input/output signal interfaces, as well as combinations comprising at least one of the foregoing. For example, the controller may include input signal filtering to enable accurate sampling and conversion or acquisitions of such signals from communications interfaces. As described above, exemplary embodiments of the present invention can be implemented through computer-implemented processes and apparatuses for practicing those processes.

Initially, the players indicate or input the quantity of players participating in the game (see Step 202). This input can be performed by using the game button or another switch on the game. The player then select a certain quantity of game pieces from a general pool of game pieces (see Step 204). Depending on the instructions provided with the game, each player selects a certain quantity, such as seven. After each player has his or her game pieces, the players determine which player goes first, which can be performed in a variety of ways (see Step 206). The selected first player presses the game button to start that player's (see Step 208). Upon the actuation of the game button, a timer or timing mechanism of the game starts and the time of game play for the current (in this case the first) player is tracked (see Step 210).

During the current player's turn, the current player reviews his or her game pieces and determines what options the player has to play the game pieces on the game board. In one embodiment, the game pieces can be played in a manner similar to that of the game SCRABBLE®, in that once the first player plays using the center square, subsequent players attempt to build words using at least one of the played letters/game pieces on the board. The words can be built using one or more existing game pieces on the board and can be oriented across the game board or downwards. In other embodiments, the players can develop their own requirements for game play.

As the game play continues, the controller continuously determines whether the cumulative game play time for the current player is equal to or greater than any of the points in time at which a bonus space no longer is available to the current player (see Step 212). If no bonus space time has been reached yet, then all bonus space indicators are illuminated. If a period of time associated with a bonus space or function has elapsed, the indicators for the remaining available bonus spaces are illuminated (see Step 214). The controller continuously checks the elapsed game time and updates the unavailability of bonus spaces by no longer illuminating any indicators associated with bonus spaces for which the available time has lapsed.

During his or her turn, the current player plays the selected game pieces and draws the same quantity of replacement game pieces from the available game pieces (see Step 216). The player calculates the points earned during that turn (such as by adding up the values of the played game pieces) and the current player presses the game button to indicate that the turn is over (see Step 218). The pressing of the game button stops the timing of the current player's game play and starts the timing of the next player's turn. If the current player played all of that player's game pieces and no more pieces are available and no plays can be made (see Step 220), then the game ends (see step 222) and the players determine the winner of the game. In one embodiment, the player with the most points at the end is the winner. If the current player still has remaining game pieces or if moves by a player can still be made, then the game continues to the next player and the timer tracks the game play time for the next player. An evaluation of the next player's playing time is made at Step 212 and the indicators for the available bonus spaces are illuminated for that player.

An exemplary embodiment of a method of game play is also illustrated in FIG. 12. The actions and steps illustrated in FIG. 12 are indicative of a portion of a method of game play and in particular, to a portion of a method in which the determination of available functions is made. In various embodiments, different and additional steps and actions can be combined with those illustrated in FIG. 12 to form a method of game play.

Referring to FIG. 12, a timer is started for the current player to track the game play time (see Step 252). On a continual basis, the elapsed game play time for the current player is tracked and maintained (see Step 254). If the elapsed game play time is less than the time limit for the availability of the first function or bonus (see step 256), then all of the bonus space indicators on the game board are illuminated (see Step 258) and the current player's turn continues (see Step 272). If the elapsed game play time is greater than the time limit for the first bonus spaces, the process continues to Step 260. At this point, if the elapsed game play time is less than the time limit for the unavailability of the second bonus spaces (see Step 260), then the bonus spaces other than the first bonus spaces are illuminated (see Step 262) and current player's turn continues. If the elapsed game play time is greater than the time limit for the second bonus spaces, the process continues to Step 264. If the elapsed game play time is less than the time limit for the unavailability of the third bonus spaces (see step 264), then the bonus spaces on the game board other than the first and second bonus spaces are illuminated (see Step 266) and the current player's turn continues. If the elapsed game play time is greater than the time limit for the third bonus spaces, the process continues to Step 268. If the elapsed game play time is less than the time limit for the availability of the fourth bonus spaces (see Step 268), then the bonus spaces other than the first, second and third bonus spaces are illuminated (see Step 270) and current player's turn continues. If the elapsed game play time is greater than the time limit for the fourth bonus spaces, then no bonus space indicators are illuminated and the current player's turn continues. In one method of game play, when a player's time is running out, an audible output, such as a sound will be generated.

The game may be played in one of multiple settings or game play modes, which can be selected by the players. In one game play mode, the game can be played in a similar to SCRABBLE® and light up spaces are provided for effect, but otherwise do not modify the game play. In another game play mode, the game can be played in a "tournament" style in which each player has a certain amount of time (such as 25 minutes) for all of the player's turns during the game which can otherwise be played in a manner similar to SCRABBLE®. In another game play mode, the game can be played in a "lights out" timed mode as described above where some of the functionality and bonus features of the game become unavailable as the game progresses. In an alternative embodiment, the LEDs associated with the bonus spaces may be turned off in a pattern from the center outward to the edges of the game board.

While the invention has been described with reference to one or more exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A board game played by at least two players, the board game comprising:

a game playing area, the game playing area defining a plurality of spaces for use with a plurality of game pieces, wherein the game pieces are placed on the plurality of spaces during gameplay and wherein the plurality of spaces including a first type of space and a second type of space, a value of the second type of space being different than a value of the first type of space, the plurality of spaces including a plurality of spaces of the first type and a plurality of spaces of the second type; and an electronic control system, the electronic control system including a timing mechanism, the electronic control system being configured to change the value of the plurality of spaces of the second type based on an elapsed time as determined by the timing mechanism, wherein the electronic control system changes the value of the plurality of spaces of second type by changing the color of the plurality of spaces of the second type.

2. The board game of claim 1, wherein said timing mechanism is programmable and said elapsed time can be changed by one of said players.

3. The board game of claim 1, including a player indicator that identifies a number corresponding to the number of players playing the game, the player indicator being programmable so that it can be changed by one of said players.

4. The board game of claim 1, wherein said second type of space includes a visual indicator associated therewith, said visual indicator configured to change upon receiving a signal after the elapsed time, the visual indicator being a light emitting device.

5. The board game of claim 1, wherein said electronic control system is programmable to allow one of said players to change the value of the at least one space of the second type.

6. The board game of claim 1, wherein said first type of space is a regular value space and does not change during the game.

7. The board game of claim 1, including an actuator for one of said players to touch to stop the timing mechanism for said one of said players and to start the timer for another one of said players.

8. The board game of claim 1, including a speaker for providing an audible signal when said electronic control system changes the value of the plurality of spaces of the second type.

9. The board game of claim 1, including a monitor that displays the change in the value of the plurality of spaces of the second type based on the elapsed time.

10. A board game played by at least two players, the board game comprising:

a game playing area, the game playing area defining a plurality of spaces, the plurality of spaces including a first plurality of a first type of space and a second plurality of a second type of space, a value of the second type of space being variable and a value of the first type of space being constant; and an electronic control system, the electronic control system including a controller, the controller being configured to count a number of turns of each player and change the value of the plurality of second type based on the number of turns as determined by the controller, wherein the controller changes the value of the second plurality of second type of space by changing the color of the second plurality of the second type of space.

11. The board game of claim 10, including a player indicator that identifies a number corresponding to the number of players playing the game, the player indicator being programmable so that it can be changed by one of said players.

12. The board game of claim 10, wherein said second plurality of second type of space includes a visual indicator associated therewith, said visual indicator configured to change upon receiving a signal after the number of turns, wherein the visual indicator is a light emitting device.

13. The board game of claim 10, wherein said electronic control system is programmable to allow one of said players to change the value of the at least one space of the second type.

14. The board game of claim 10, wherein said electronic control system is programmable by one of said players to change a level of difficulty assigned to one of each of said players.

15. The board game of claim 10, including an actuator for one of said players to touch to count said players turn and to start the timer for another one of said players.

16. The board game of claim 10, including a speaker for providing an audible signal when said electronic control system changes the value of the second plurality of the second type of space.

17. A board game played by at least two players, the board game comprising:

a game playing area, the game playing area defining a plurality of spaces, the plurality of spaces including a first plurality of a first type of space and a second plurality of a second type of space, a value of the second type of space being different than a value of the first type of space; and an electronic control system, the electronic control system including a controller, the controller being configured to change the value of the second plurality of the second type of space as a function of time and a location of the second plurality of the second type of space on said game playing area, wherein the controller changes the value of the second plurality of second type of space by changing the color of the second plurality of the second type of space.

18. The board game of claim 17, including a player indicator that identifies a number corresponding to the number of players playing the game, the player indicator being programmable so that it can be changed by one of said players.

19. The board game of claim 17, wherein said electronic control system is programmable by one of said players to change a level of difficulty assigned to one of each of said players.

* * * * *